US006132661A

United States Patent [19]

Kurihara et al.

[11] Patent Number: 6,132,661

[45] **Date of Patent: *Oct. 17, 2000**

[54] LONGITUDINALLY STRETCHED NONWOVEN FABRIC AND METHOD FOR PRODUCING THE SAME

[75] Inventors: Kazuhiko Kurihara, Itabashi-ku; Hiroshi Yazawa, Kunitachi; Shuichi Murakami, Itabashi-ku; Yoichi Mazawa, Yono; Yuki Kuroiwa, Shiki; Yukio Matsumura, Kawaguchi; Kazuhiro Yabe, Meguro-ku; Shin'ichi Umejima, Kawasaki, all of Japan

[73] Assignees: Nippon Petrochemical Company, Limited; Polymer Processing Research Inst., Ltd., both of Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/972,077

[22] Filed: Nov. 17, 1997

[30] Foreign Application Priority Data

Nov. 19, 1996 [JP] Japan ..... 8-323499

[51] Int. Cl.[7] ..... D01D 5/12

[52] U.S. Cl. ..... 264/210.7; 264/176.1; 264/210.8; 264/211.14; 264/211.22

[58] Field of Search ..... 442/408, 387; 156/167, 174; 28/104, 112, 172.2; 264/176.1, 210.7, 210.8, 211.14, 211.22

[56] References Cited

U.S. PATENT DOCUMENTS

| | | | |
|---|---|---|---|
| 4,992,124 | 2/1991 | Kurihara et al. | 156/161 |
| 5,312,500 | 5/1994 | Kurihara et al. | 156/62.4 |

FOREIGN PATENT DOCUMENTS

| | | |
|---|---|---|
| 0 379 763 | 8/1990 | European Pat. Off. . |
| 0 733 460 A2 | 9/1996 | European Pat. Off. . |
| 0 757 127 A1 | 2/1997 | European Pat. Off. . |
| 0 796 940 A1 | 9/1997 | European Pat. Off. . |
| 0 821 044 A2 | 1/1998 | European Pat. Off. . |
| 60-25541 | 6/1985 | Japan . |
| 02269859 | 4/1990 | Japan . |
| 2-242960 | 9/1990 | Japan . |
| 91036948 | 6/1991 | Japan . |
| WO96/17121 | 6/1996 | WIPO . |

*Primary Examiner*—Blaine Copenheaver
*Assistant Examiner*—John J. Guarriello
*Attorney, Agent, or Firm*—Scully, Scott, Murphy & Presser

[57] ABSTRACT

A longitudinally stretched nonwoven fabric and a method for producing the same, which nonwoven fabric is a web mainly composed of long fiber filaments of 3 μm to 15 μm in diameter and made by short distance stretching in one direction at a stretching ratio of at least 5, and which production method is characterized in the steps of: maintaining the spun filaments in a draftable state; cooling the filaments with a cooling fluid, then guiding the filaments onto a conveyer with inclining the flow of filaments toward the transferring direction, and sucking by a reduced pressure from the back side of said conveyer, and further subjecting the web of filaments to short distance stretching in the longitudinal direction.

11 Claims, 4 Drawing Sheets

LONGITUDINALLY STRETCHED NONWOVEN FABRIC AND METHOD FOR PRODUCING THE SAME

BACKGROUND OF THE INVENTION (1) Field of the Invention

The present invention relates to a longitudinally stretched nonwoven fabric composed of long fibrous filaments and a method for producing the same. The longitudinally stretched nonwoven fabric prepared according to the present invention can be used as a material having improved strength and dimensional stability in the production of web materials for making nonwoven fabric products in which the strength in one direction is required or for making cross-laminated nonwoven fabrics.

(2) Description of Prior Art

As the methods for producing a nonwoven fabric, there are known a spunbond method, a melt-blowing method and spun lace method. These methods are hereinafter referred to as "spunbond method in a broad sense"). These are the leading methods for producing nonwoven fabrics in view of their advantages in the economy and the applicability to mass production.

These prior art spunbond nonwoven fabrics in a broad sense are random nonwoven fabrics. However, most of them are poor in strength and dimensional stability. Therefore, the present inventors have eliminated these weak points and they accomplished methods for producing nonwoven fabrics by stretching or cross-laminating nonwoven fabrics, which are fully disclosed in Japanese Patent Publication No. 3-36948, Japanese Patent Laid-Open Publication Nos. 2-269859 and 2-292960 as prior inventions.

In addition, a method for producing a longitudinally stretched nonwoven fabric is also disclosed in Japanese Patent Publication No. 60-25541 (herein after referred to as "prior invention V"). In this method, it is intended to solve the problem of the flowing tendency of F. J filaments on an inclined conveyer by giving a self-sticking property to filaments. However, the above method relying on the self-sticking property of filaments results in the insufficient cooling and the lowering in stretching property of filaments. In addition, because filaments are aligned depending solely on the inclination of a conveyer in this method, it is required to increase the inclination of the conveyer in order to achieve highly aligned alignment, which causes an unstable operation. Moreover, this process is characterized in that the diameter of filaments after stretching is reduced to a value less than 2 $\mu$m. However, in the spinning process like this, it was found out that, because too fine filaments cause the increase in the number of broken filaments and the lowering of the stretching property of filaments. Therefore, the adequate diameter of filaments is in the range of 5 $\mu$m to 20 $\mu$m, which fineness is suitable for obtaining the filaments in the range of 3 $\mu$m to 15 $\mu$m in diameter after stretching. It was also found out that stronger filaments can be obtained by avoiding the excess supply of hot air stream in order to avoid the excessive reduction of the diameter of filaments.

In this prior invention V, any special measure is not taken in the stretching process.

PROBLEMS TO BE SOLVED BY INVENTION

Although the nonwoven fabric in the above-noted prior invention V can be stretched longitudinally and has strength at a certain level. However, the possible ratio of stretching is small and the strength is not sufficient yet. Moreover, the stretched nonwoven fabric is stiff and it frequently cause problems in the uses as a nonwoven fabric.

As a result of intensive studies made by the present inventors concerning the causes of the low stretching ratio and low strength and the stiffness of stretched web, the following facts came to attention.

(1) Because spun filaments are subjected to heat treatment, their stretching property is lowered.

(2) In a stretching process, a large proportion of filaments are not stretched because the alignment of filaments is not sufficient. It was understood that, when a large proportion of such filaments exists, it is impossible to achieve a high stretching ratio, and accordingly, their strength cannot be improved. In other words, in the stretching process, only the longitudinally aligned filaments are substantially stretched longitudinally but the filaments which are not longitudinally aligned still remain as they stand without stretching.

In addition, it was also found out that these unstretched filaments remaining in the insufficiently stretched nonwoven fabric are softened and melted in the subsequent stretching step and heat treating step and they act as an adhesive to cause the hardening of the web. Particularly, this tendency is notable in the material of polyethylene terephthalate.

(3) It was found out that the stretching ratio and the strength can not be improved when the stretching method for the conventional spun tows and films are employed for the stretching of a longitudinally aligned spun web. This may be attributed to the low probability that the spun filaments bridge over the stretching interval.

The short distance stretching method is also employed in the longitudinal stretching of films. In this case, the stretching distance is usually shortened by sharply turning the material using small diameter rolls. However, when this method is applied to the spun web of the present invention, the fuzzy filaments of web are liable to cling around the rolls which lowers the stability in stretching operation.

Furthermore, because the spun web is relatively low in unity and uniformity in comparison with films, it is difficult to fix a stretching point during the stretching operation. This may also cause the lowering of the ratio of stretching and the strength by stretching.

(4) As another cause to impair the stretching property, there is the generation of a large amount of fuzzy filaments due to the poor slidability between the filaments and metallic parts and that among filaments themselves. The fuzzy filaments are liable to cling over rolls to impair the stretching property.

BRIEF SUMMARY OF THE INVENTION

As a result of intensive studies made in order to solve the above-described problems., the inventors have accomplished an improved nonwoven fabric and a method for preparing the same of the present invention with improved economy and applicability to mass production by employing the most efficient spunbond method in a broad sense.

The present invention is characterized in the following features.

The longitudinally stretched nonwoven fabric according to the present invention is a web which is mainly composed of long fiber filaments of 3 $\mu$m to 15 $\mu$m in diameter and made by short distance stretching in one direction at a stretching ratio of at least 5. The web of the above longitudinally stretched nonwoven fabric has a longitudinal strength of 1.2 g/d or more at 5% elongation and a breaking strength of 2 g/d or more when the web is not reinforced by any of embossing, calendering or adhesive treatment.

In the method for producing a longitudinally stretched nonwoven fabric in which filaments are made by extruding a melted polymer with a spinning means having a plurality of fine nozzles and taking up the filaments at a high drafting ratio under the friction of a high speed fluid to accumulate them on a conveyer, the improvement according to the present invention comprises the steps of:

(1) maintaining the filaments extruded from nozzles in a melted state to be drafted;

(2) then, cooling the filaments with a cooling fluid;

(3) guiding the flow of cooled filaments onto a conveyer while inclining the filaments in the direction of transferring;

(4) forming a web by sucking the filaments under a reduced pressure in the linear transverse direction from the opposite side of the loading surface of the conveyer; and (5) subjecting the web to a short distance stretching.

The loading surface of the above conveyer is inclined in such a manner that the conveyer descends toward the transferring direction. The cooling fluid is aqueous spray or, if necessary, cooling air containing an oily agent for improving the stretching property and the electrostatic characteristics. The above spinning means involves a die for producing melt-blown nonwoven fabrics which die comprises a plurality of spinning nozzles that are transversely aligned in a row and hot air jet nozzles that are disposed on both sides of the row of spinning nozzles. The high speed fluid comprises the hot air ejected from the hot air jet nozzles and the above-mentioned cooling fluid.

Furthermore, the spinning means involves a die for making spunbond nonwoven fabrics which comprises a plurality of spinning nozzles and ejectors to draw at a location under the nozzles and a heat retaining tube is provided just below the nozzles so as to maintain inside the heat retaining tube at a temperature higher than the spinning temperature by 80° C. or more; thereby ejecting the cooling fluid in the direction below the ejectors.

In the spinning means involving a die for making melt-blown nonwoven fabrics, the flow of the filaments spun from the die is inclined toward the transferring direction of the conveyer by reducing the amount of hot air stream from the slits on the side of transferring direction of the conveyer than the hot air stream from the slits on the opposite side. The flow of filaments is directed toward the transferring direction of the conveyer by colliding the flow to a barrier wall disposed with an inclination relative to the loading surface of the conveyer. The web is subjected to multi-stage stretching operation which comprises a short distance stretching immediately after the leaving from the conveyer and a subsequent longitudinal stretching in the total stretching ratio of 5 or more. The longitudinal stretching of the web is carried out by applying at least one of the means selected from the following measures in order to fix a stretching point;

(1) squeezing the web using a nip roll;

(2) heating the stretching point using an infra-red heater; and (3) blowing hot air of a linear cross-section to the stretching point.

BRIEF DESCRIPTION OF DRAWINGS

These and other objects and features of the present invention will become more apparent from the description taken in connection with the accompanying drawings in which.

DETAILED DESCRIPTION OF EMBODIMENTS

Figure 1:
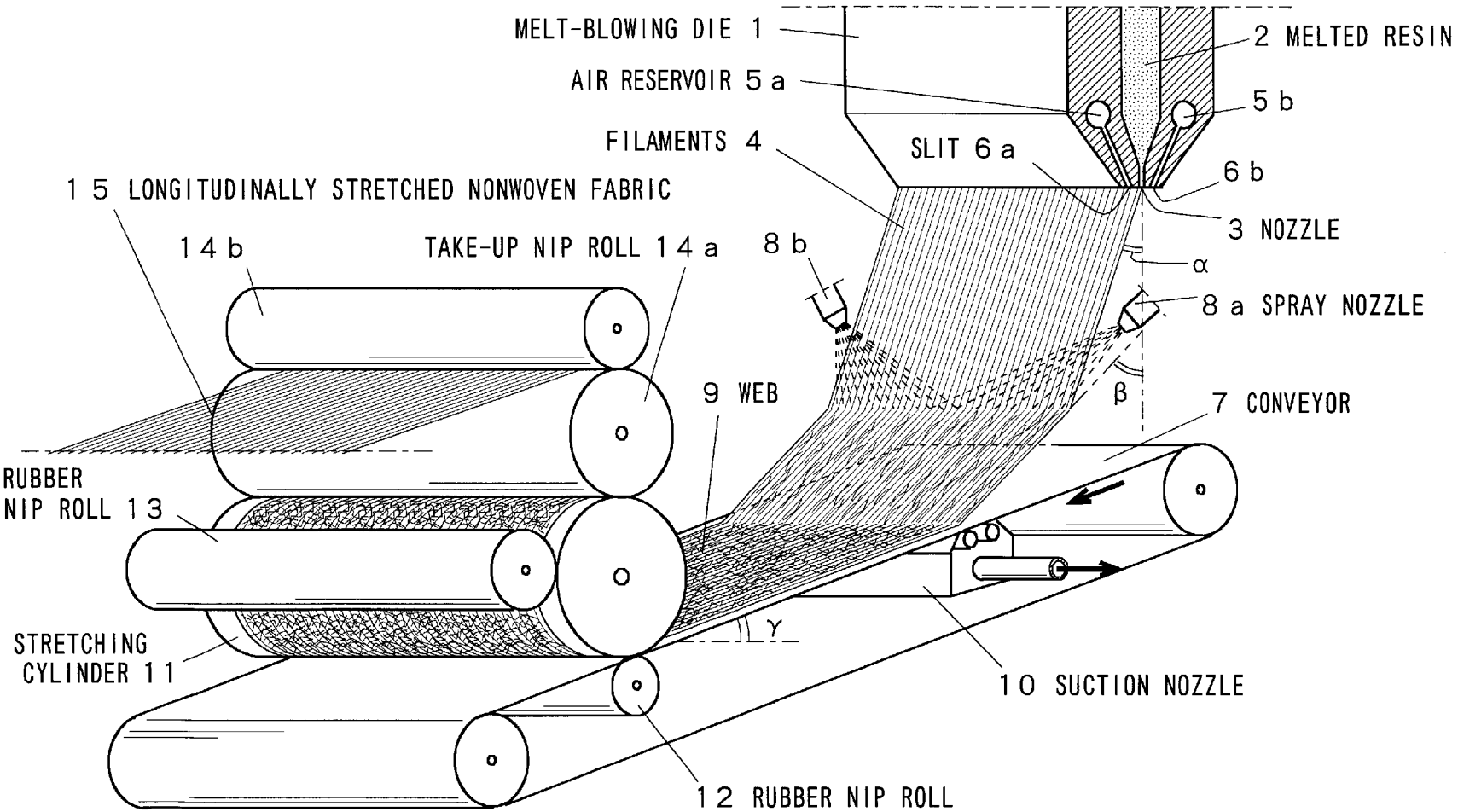
FIG. 1 is a perspective view of an apparatus in an embodiment of the present invention for producing a longitudinally stretched nonwoven fabric.

In the method of the present invention, the melted filaments immediately after the extrusion from the nozzles are subjected to positive heating and the temperature of the surrounding atmosphere close to the nozzles is kept at an elevated temperature in order to maintain the filaments in a state to be draftable. Meanwhile the thickness (diameter) of filaments is reduced by raising the drafting ratio. The temperature during this period is set at sufficiently high level above the melting point of the filaments, so that the molecular orientation of the filaments is not caused. In other words, the molecular orientation of filaments is suppressed as low as possible, which is one of the features of the present invention being different from the so-called spunbond spinning in a wide sense.

The term "close to"the nozzles noted above generally means the position immediately after the spinning of the filaments from the nozzles. The filaments are usually extruded downward, in which the wording "just below" is used. Accordingly, when filaments are extruded upward, "just above" is meant. When the filaments are extruded sideways, the position close to the side is meant. All of them are included in the present invention.

As a means to raise the surrounding temperature just below the nozzles, any means such as the hot air blown out of a die, the heating with a heater or a heat retaining tube or the like can be used. As a means to heat the filaments of melted polymer, infrared ray radiation or laser radiation may be used. The specific means of them will be described in more detail in the following description on embodiments.

As a means to apply a draft tension to filaments, a means to use a melt-blow (hereinafter referred to as "MB") die is known. This is particularly suitable for the method of the present invention because it can suppress the molecular orientation of filaments by raising the temperature of hot air. In the usual MB spinning process, however, the filaments are accumulated in a random fashion on the conveyer without being well aligned and their stretching property is lowered by the influence of heat treatment effect caused by the hot air. Accordingly, in the feature of the present invention, the cooling and the aligning of filaments are attained by applying the air containing aqueous spray to the filaments with an inclination relative to the surface of conveyor.

As another method to provide a draft tension to filaments, a spunbond method in a narrow sense (hereinafter referred to as "SB") is known. This SB method employs the so-called ejectors or air suckers disposed under a plurality of spinning nozzles. In this method, the cooling is effected by cold air at a position just below nozzles and, therefore, the molecular orientation of filaments is developed and the strength of the filaments is improved. In the meantime, the disposition of filaments on the conveyer is random and the alignment is not satisfactory. In the present invention, then, the molecular orientation is reduced by incorporating a means to maintain the temperature of polymer just below the nozzles at an elevated temperature. Furthermore, a good stretching property is imparted to filaments by subjecting them to sufficient cooling with supplying aqueous spray or cold air into an ejector, and the alignment of filaments is improved by guiding the fluid containing these filaments in a inclined direction onto the surface of a conveyer.

In the spinning process, the filaments can be accumulated on the conveyer in a good alignment by spinning it in the direction being not in a right angle but in an oblique angle relative to the surface of conveyer.

As a method to achieve the inclined spinning, it was found out effective to incline the direction of nozzles for filament spinning relative to the conveyer surface, to incline the filaments with the aid of a fluid, and to incline the conveyer surface relative to the direction of spun filaments. Furthermore, it was also found to be difficult to achieve the inclined spinning with maintaining preferable filament alignment using only one of the above means. Therefore, it is desirable to employ a plurality of means in combination.

A fluid is used in the above methods to achieve the inclined spinning, in which it is desirable to heat the fluid when it is used at a position close to nozzles. When the fluid is not used at a position close to nozzles, it is necessary to heat positively the spun filaments at the position close to nozzles. This is necessary in order to attain the reducing of the thickness of spun filaments by drafting with avoiding the molecular orientation of filaments as low as possible. In this regard, the method of the present invention completely different from the conventional method such as the SB method in which it is intended to produce nonwoven fabrics with improved strength by developing the molecular orientation of filaments through drafting.

The above will be described more particularly in the following description on embodiments.

Meanwhile, in the present invention, the development of the molecular orientation of filaments is possibly suppressed in the spinning process, but it is desirable for the filaments to be possibly aligned longitudinally (in the direction of production line).

In the method of the present invention, as a fluid to be used for obliquely moving the filaments, a cold fluid, particularly, a fluid containing aqueous spray is most desirable when it is used at a position close to a conveyer. The purpose of the application of a cold fluid is to prevent the filaments from the influence of heat and to retard the developing of crystallization through the rapid cooling of the spun filaments. It was found out that, if the influences of the heat of spun filaments and heating fluid remain, the filaments on a conveyer are subjected to thermal effect of them to develop crystallization and their stretching property is impaired.

Concerning the stretching property, the influence by heat is significant particularly in polyester filaments and also it is observed in polypropylene.

In the method of the present invention, the aqueous spray is used as described above. This is done for the purpose of rapidly cooling of the melted filaments so as to attain the appropriate stretching with a higher stretching ratio and a higher strength. In addition, it is effective to avoid the sticking of spun web to a conveyor surface and the blowing off of the material by the cooling spray. Accordingly, it is possible to strengthen the supply of cooling spray, which will produce desirable effects in view of the stabilization and proper alignment of spun filaments.

An oily agent used for the spinning and stretching is added to the liquid spray. The oily agent can impart stretching property and anti-electrostatic property to the filaments. With this addition of an oily agent, it is possible to improve the stretching property and to reduce the formation of fuzzy filaments, which brings about the improvement in the strength and elongation after stretching.

The conveyors are exemplified by a flat belt type one as shown in the attached drawings and a drum-screen type one which is often used in the production of melt-blown nonwoven fabrics. The inclination in the drum-screen type conveyor means that the direction of the extrusion of spun filaments from nozzles is inclined toward a winding device from the vertical line.

Various kinds of materials can be used for the conveyors such as those used for producing the nonwoven fabrics, made of metal wire or plastics wire. Various kinds of weaving methods for making their reticular structures may be employed such as those for making plain fabrics, twill weaves or the like. Furthermore, the satin weaving is particularly preferable, in which the warp is arranged uninterruptedly on the surface over weft and, by making the warp running in parallel upper side, the longitudinal alignment of web filaments can be improved to increase the strength of a web.

In the process on a conveyor, it is possible to stabilize the web which is unstable due to the inclination of a conveyor and further to produce the heat removing effect by sucking the filaments with a reduced pressure from the side opposite to the loading surface of conveyer. It is not necessarily to stabilize the web on a conveyer by the self-sticking property of filaments as disclosed in Japanese Patent Publication No. 60-25541. It is important to apply this suction with a reduced pressure in a narrow linear mode in the transverse direction of the conveyer. In the conventional broad-sense SB nonwoven fabric process, the suction by a reduced pressure is often carried out but the area of suction is broad in this case. Accordingly, it is done for the purpose of improving the uniformity in the basis weight within the plane of a web by increasing the suction of reduced pressure in the area of less amount of filaments and to achieve possibly the random alignment of filaments. On the other hand in the present invention, the primary object is to improve the alignment of filaments, further to prevent the filaments from scattering on a conveyer and to enhance the stretching property of filaments by removing the heat of filaments on the conveyer.

In addition, the suction with a reduced pressure produces an effect to reduce the influence of water content in the subsequent pressure-sheeting process and stretching process because the suction can also remove water content. In the case of polyester, the stretching property is largely influenced by water content. The uneven distribution of water impairs the uniformity of stretching and reduces the stretching ratio and the strength of stretched web.

Furthermore, it has become possible to recover the stretching oil agent and water by the suction under reduced pressure.

In the present invention as described above, the ordinary suction blowers that are used in the production of spunbond nonwoven fabric and melt-blown nonwoven fabric, can be used. So that, not only the adjustment of the landing point of filaments on a conveyor but also the increasing of the suction area and also the multi-stage suction can be attained, thereby enhancing the stability of the spinning operation.

In the stretching of the method of the present invention, the first step operation is done with the short distance stretching.

The short distance stretching as referred to herein is a method to stretch a web with different surface speeds between a set of two adjacent rolls, in which a web is stretched within a short stretching distance (the distance between a starting point and an end point of stretching) and it is desirable that the stretching distance is shorter than 100 mm. It is important to maintain the stretching distance as short as possible in order to carry out the stretching of each filament effectively, particularly in the method of the present invention when the filaments are not longitudinally aligned, or even when they are aligned longitudinally, the filaments are bent to a certain degree.

In an ordinary short distance stretching of films, small diameter rolls are used as described above. However, this is not suitable for the method of the present invention because the filaments of web are liable to cling over the small diameter rolls which obstructs a stable operation.

The quantity of heat required for the short distance stretching operation is usually supplied by heating the rolls that are used for stretching and the supplementary heating is done by the supply of hot air or infrared rays at the stretching point. Besides the above, the heating with hot water or steam can also be used.

It is generally important to fix the stretching point in the stretching operation of webs. If the stretching point is not fixed, the entire web can not be stretched uniformly, so that the stretching ratio may not be raised. Furthermore, portions of different stretching ratios are formed in a stretched web, which results in a web with insufficient strength. The present inventors have achieved the improvement in the stretching property of a longitudinally aligned web by employing the following stretching method.

The width of the usual final product of the longitudinally stretched nonwoven fabric according to the present invention is from 1 m to 2 m or more. However, an easier operation of short distance stretching can be attained if it is carried out using a spun web producing apparatus having a narrow die in which the spinning and the subsequent pre-stretching are carried out, because the stretching device can be simplified. Then, a broader longitudinally stretched nonwoven fabric can be prepared by placing these pre-stretched webs side by side and subjecting them to the main stretching operation. Meanwhile, the shrinkage in the width of a web is small because the stretching ratio in the main stretching operation is smaller. Accordingly, overlapped portions do not attract attention because the degree of overlapping of webs can be made small when the pre-stretched webs are placed side by side. Furthermore, in the main stretching process, the stretching distance in the short distance stretching can be made relatively large because the pre-stretched webs are already stretched longitudinally.

In the multi-step stretching process according to the present invention, not only the short distance stretching but also various other methods used for ordinary web stretching can be employed as the stretching process after the first step. Other stretching methods are exemplified by roll stretching, hot water stretching, steam stretching, and hot plate stretching. The short distance stretching is not always necessary in this stage because each filament is already extended in the direction of length in the first step.

In the process for producing the longitudinally stretched nonwoven fabric according to the present invention, the ratio of stretching varies with the kinds of polymer of filaments forming a web, the spinning method and the method of aligning filaments. However, when any kind of polymer and any method are used, the stretching ratio must be so selected as to achieve a high degree of orientation and a high strength of a web.

The above-mentioned stretching ratio is defined by the following equation with the marks indicated on a web at a given interval in the stretching direction of a web prior to the stretching.

$$\text{Stretching Ratio}=(\text{DAS})/(\text{DBS})$$

wherein (DAS) is the distance between marks after stretching and (DBS) is the distance between marks before stretching.

This stretching ratio does not always coincide with the stretching ratio of individual filament that is different from the stretching of ordinary long fiber filament yarns.

The polymers which is preferably used as the structural member of the filaments in the present invention are exemplified by thermoplastic resins such as polyethylene, polypropylene, polyester, polyamide, polyvinyl chloride family resins, polyurethane, fluorocarbon resin and their modified resins. In addition, the polymers which can be applied with the wet spinning or dry spinning method such as polyvinyl alcohol family resins and polyacrylonitrile family resins are also used.

Furthermore,, the method of the present invention can be applied to the filaments of combined spinning or conjugate spinning as described in International Patent Publication WO 96/17121 as a prior invention filed by the inventors of the present invention.

The longitudinally stretched web in the present invention can be used by enlarging its width by spreading while maintaining the longitudinal orientation of filaments. In this case, the filaments are obliquely crossed to some extent.

The filaments used in the method of the present invention are long fiber filaments. The long fiber filaments as referred to herein mean any fibers which are substantially long. More particularly, the average length of filaments is more than 100 mm.

In the method of the present invention, if the diameter of filaments is larger than 50 $\mu$m, the filaments are too rigid and the entangling of filaments is insufficient. The diameter of filaments is preferably 30 $\mu$m or less and more preferably less than 25 $\mu$m.

When a nonwoven fabric with particularly high strength is produced, the diameter of the filaments is desirably larger than 5 $\mu$m.

The diameter and length of the filaments used in this invention are measured using a microphotograph.

As described above, the high strength of web can be attained in the present invention. This strength is not the value without reinforcing treatment for web such as embossing. In the cases of ordinary spunbond nonwoven fabric and melt-blown nonwoven fabric, the product of nonwoven fabric for practical uses can be made only when they are processed through reinforcing treatment such as embossing, calendering, adhesive treatment, needle punching, or stitch bonding.

The methods of the present invention will be described with reference to the accompanied drawings.

FIG. 1 is a perspective view showing an embodiment of the apparatus for use in the production of a longitudinally stretched nonwoven fabric of the present invention.

An MB die 1 is illustrated with its cross section in order to indicate its structure in detail. The melted polymer 2 fed from a gear pump (not shown) is extruded from a plurality of nozzles disposed at the end portion of the die to form a large number of filaments. High pressure hot air that is heated to a temperature above the melting point of the polymer is fed to air reservoirs 5*a* and 5*b* formed on both sides of nozzles 3 and the hot air is blown out from the slits 6*a* and 6*b* disposed on both sides of the nozzles 3. The frictional force generated by the blowing of the hot air imparts drafting force to the filaments 4 and the diameters of the filaments 4 are reduced. The above-described mechanism is identical to that of the conventional MB process.

In the present invention, the temperature of the high pressure hot air is set to a value that is higher by 80° C., preferably by 120° C. and more preferably by 200° C. than the spinning temperature. Moreover, in the process of the present invention, the direction of the outlet flow of filaments is inclined with an angle a relative to the vertical line by reducing the stream of hot air from the reservoir 5*a* than the stream from the reservoir 5*b* by changing the feed rates of air streams to the air reservoirs 5*a* and 5*b*. The provision of an angle a of the direction of the outlet flow of the filaments can also be attained by inclining the MB die 1 itself and, furthermore, both the above methods can also be employed together.

Aqueous spray is ejected from the spray nozzles 8*a* and 8*b* toward the conveyer 7 in the intermediate portion between the MB die 1 and the conveyer 7. Although a plurality of spray nozzle is used on the respective sides, only one spray nozzle is illustrated on each side in order to avoid complexity. The filaments 4 are accumulated in the form of a web 9 on the conveyer 7 with an inclination of an angle β which is larger than the angle α by the force of the ejected aqueous spray. The conveyer 7 is inclined by an angle γ relative to the horizontal plane, thus the take-up portion is lower than the landing point of filaments 4. The cooling spray does not necessarily contain water but it may be cold air.

As described above, the filaments 4 of web 9 on the conveyer 7 is longitudinally aligned owing to the effects of the inclination of the conveyer and the force of the air stream or the aqueous spray. The web 9 that is cooled by the water spray is scattered on the conveyer due to the air stream because it has no self-sticking property. The filaments, however, are prevented from scattering and are settled on the conveyer by the aid of the suction effected of the linear suction nozzles 10 disposed on the reverse side of the conveyer in a transverse direction.

It was found out that the alignment of filaments can be achieved effectively by keeping the side of transferring direction of conveyor at a degree of reduced pressure of below 30 mm-$H_2O$, more preferably below 10 mm-$H_2O$ by using the reduced pressure nozzles 10. The term "degree of reduced pressure" herein does not mean the pressure difference from the atmospheric pressure but an absolute pressure.

The web 9 on the conveyer 7 is nipped between a stretching cylinder 11 heated to a stretching temperature and a rubber-made nip roll 12 disposed on the side opposite to the loading surface of the conveyer. The web 9 is then transferred onto the stretching cylinder 11 and it is further nipped with a rubber-made nip roll 13 to be brought into close contacted with the stretching cylinder 11. The web 9 is stretched owing to the difference in speeds between those of the stretching cylinder 11 and subsequent take-up nip rolls 14*a* and 14*b* (14*b* is a rubber-made roll) to form a longitudinally stretched nonwoven fabric 15.

Figure 2:
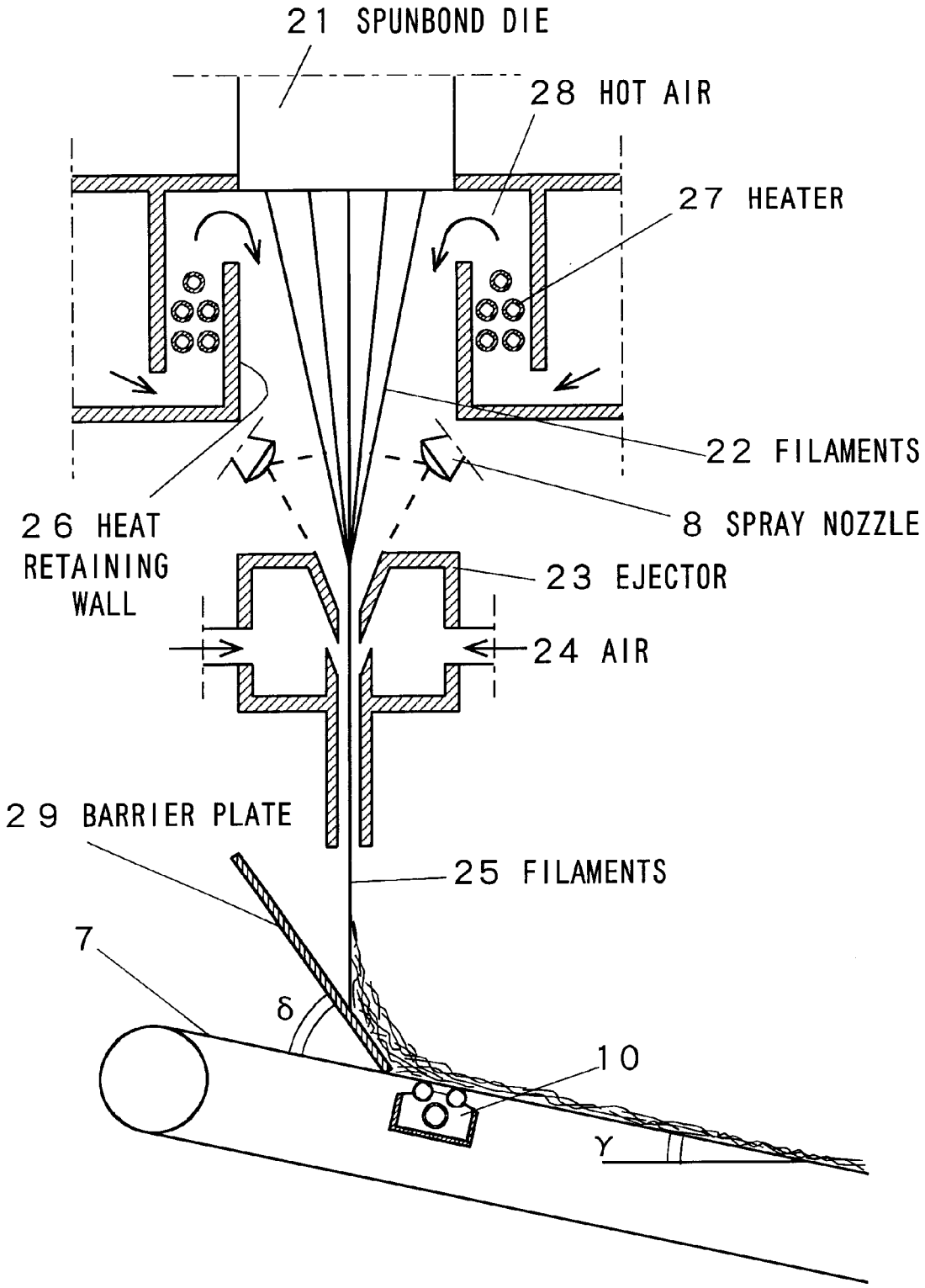
FIG. 2 is a vertical cross-sectional view of a part of the apparatus in another embodiment.

FIG. 2 is a vertical cross-sectional view showing the process in which an SB method in a narrow sense is used in the spinning process for the nonwoven fabric. In an ordinary SB spinning process, a large number of filaments 22 are spun through an SB die 21 having a large number of spinning nozzles, the filaments are sucked by the air 24 in an ejector 23 and the filaments are accumulated on a conveyer 7 with accompanied air accelerated by the nozzles of the ejector 23.

In the process of the present invention, a heat retaining wall 26 having heaters 27 in it is disposed below the SB die 21 as shown in the FIG. 2 and the air heated above the melting point of the filaments is supplied to the flow of spun filaments 22 so as to prevent the filaments 22 from being cooled. The filaments 22 is then cooled by the air containing aqueous spray supplied from the spray nozzles at the point just before the inlet of ejector 23 and the filaments are led into the ejector 23. If there is no spray nozzle 8, the filaments 22 may be melted and stick together in the ejector 23. In place of the spray nozzles 8, it is possible to add aqueous spray to the air 24 in the ejector 23.

The flow direction of filaments 25 that are accelerated in the ejector 23 is changed by a barrier wall 29 disposed with an inclination relative to the loading surface of the conveyer 7. The flow of filaments 25 is sucked by the reduced pressure suction nozzle 10, and accumulated on the inclined conveyer 7 in the like manner as the embodiment shown in FIG. 1.

The ejector 23 is disposed vertically in FIG. 2 but it is also possible to incline the direction of the outlet flow of the ejector.

The heat retaining wall 26 just below the nozzles of SB die 21 in FIG. 2, is a guide passage for the air 28 that is heated by heaters 27 and it serves as a heat retaining tube. However, it is also possible to heat directly the portion just below the nozzles by using an infrared lamp or the like as another means to maintain the portion just below the nozzles at an elevated temperature. In either case, the feature of the present invention exists in that the portion just below the nozzles is maintained at an elevated temperature in order to suppress the development of the molecular orientation even when the diameters of filaments are reduced.

It was found out that the lowering in the degree of molecular orientation and the subsequent improvement in the stretching property are attained by maintaining the temperature of the heating air 28 in FIG. 2 at a high level which is higher by 80° C., more preferably 120° C. than the spinning temperature (die temperature) of filaments.

Figure 3:
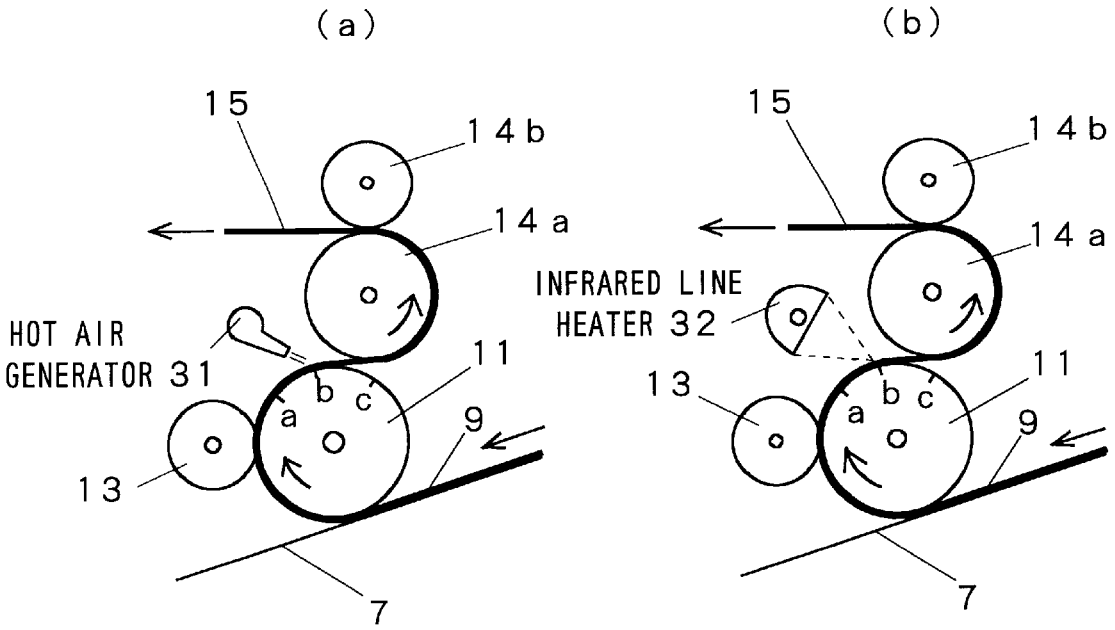
FIG. 3, (*a*) and (*b*) are side views of stretching processes according to the present invention.

FIG. 3 is a side view of the stretching process in the manufacturing apparatus as shown in FIG. 1. The stretching cylinder 11 is heated at an adequate temperature for carrying out the stretching. For example, in the case that the web material is polypropylene, the temperature is 110° C. and in the case of polyester, 85° C. The web 9 is brought into close contact with the stretching cylinder 11 by a rubber nip roll 13. If the degree of the contact is adequate, the stretching point is in a straight line in the transverse direction of the web at the point b where the web leaves the stretching cylinder 11 and an ideal short distance stretching operation can be achieved. On the other hand, if the degree of contact is too weak, the stretching point is shifted to the point a on the stretching cylinder 11 and the stretching operation is not stable. If the degree of contact is too strong, the stretching point fluctuates between the point b and point c, thus the stretching operation is also unstable.

The degree of contact can be controlled by heating the rubber nip roll 13 by using an infrared heater or the like or by regulating the adhesive property of the surface of stretching cylinder 11, and therefore, it is possible to fix the stretching point near the point b. Because these conditions vary with the line speed, basis weight and so forth, in order to fix the stretching point to the point b, it is effective to blow hot air of a linear cross-sectional shape over the point b from the hot air generator 31, as shown in FIG. 3 (A). In addition, as shown in FIG. 3 (B), it is also effective to heat the portion of line b with an infrared heater 32 which can focus its beams in a straight line.

Figure 4:
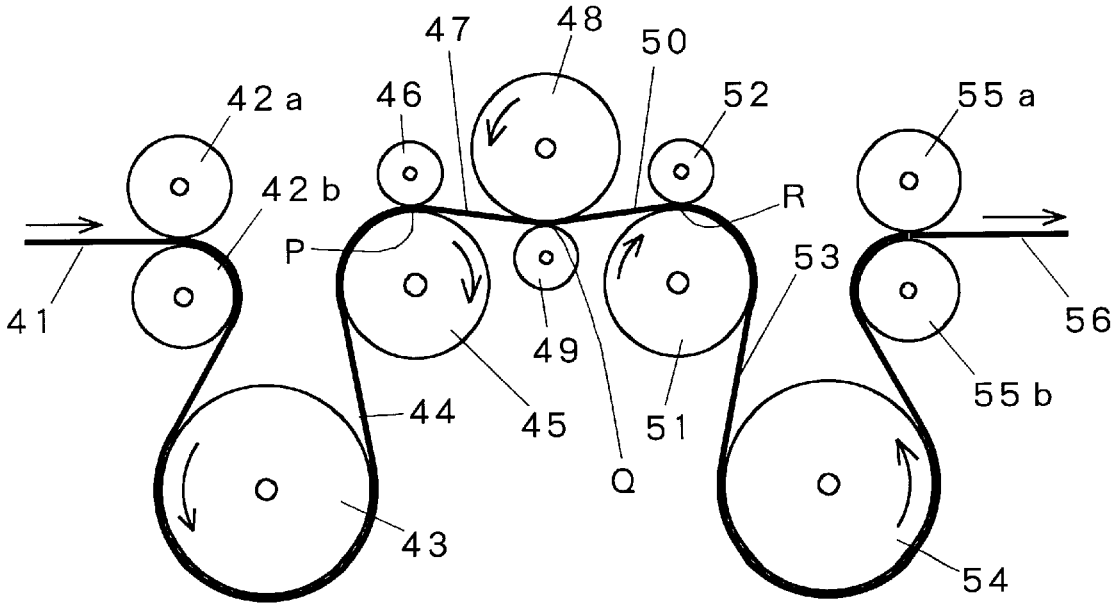
FIG. 4 is a side view of another stretching process according to the present invention.

FIG. 4 is a side view of a stretching apparatus in another embodiment.

The web 41 may be those produced with the spinning apparatus as shown in FIG. 1 or 2 or a web which is subjected to the short distance stretching using the stretching apparatus as shown in FIG. 1 or 3. The web 41 is led to the stretching apparatus through nip rolls 42*a* and 42*b*, and it is preheated by a preheating roll 43 and led to a stretching roll 45 as a web 44. The web is then subjected to longitudinal stretching between the stretching roll 45 having a rubber nip roll 46 and the stretching roll 48. The stretching distance is the traveling distance PQ of the web, which distance is defined by a nip point P formed between the stretching roll 45 and the nip roll 46 and a nip point Q formed between the stretching roll 48 and the nip roll 49, and the stretching of the web 47 is effected between the points P and Q.

When a multi-step stretching operation is required with this apparatus, further stretching is done between the stretching roll 48 and the stretching roll 51. The stretching distance in this case is the traveling distance QR of the web 50, which distance QR is defined by the point Q and the nip point R formed between the stretching roll 51 and the nip roll 52.

When the heat treatment is required after the stretching operation, the web 53 is subjected to heat treatment using a heat treatment roll 54.

The web 53 is finally obtained as a stretched web 56 through nip rolls 55*a* and 55*b*.

As described above, the stretching apparatus having a possibly short stretching distance is suitable for the stretching of a nonwoven fabric. As shown in FIG. 4, with the provision of nip rolls 46, 49 and 52 to the stretching rolls serves to fix stretching points and allows the stable operation of stretching, so that the stretching operation with a higher stretching ratio can be attained. Without the nip roll 46 and the others, the stretching points shift toward the side of heat treatment roll from the point P. So that, not only the stretching distance is extended but also the stretching points fluctuate to cause the breaking of filaments in stretching.

In view of the above-described principles, in the web suitable for the longitudinal stretching, its filaments are possibly aligned in a longitudinal direction. In other words, because the most of filaments are extended long enough in the longitudinal direction, a large proportion of filaments are caught at both ends them even when the stretching distance is not changed and the strength of web after the stretching can be enhanced.

In the apparatus as shown in FIG. 4, the heat for the stretching operation is basically provided through the heated roll, however, the hot air or infrared beams as shown in FIG. 3 can be used together. In addition, the heat can be also given by covering over the traveling distance PQ or QR and heating its inside by steam.

Even when the web obtained with the spinning apparatus as shown in FIG. 1 or 2 is narrow, a broader web can be prepared by arranging a plurality of webs side by side and then subjecting them to stretching operation using the stretching apparatus as shown in FIG. 4.

Figure 5:
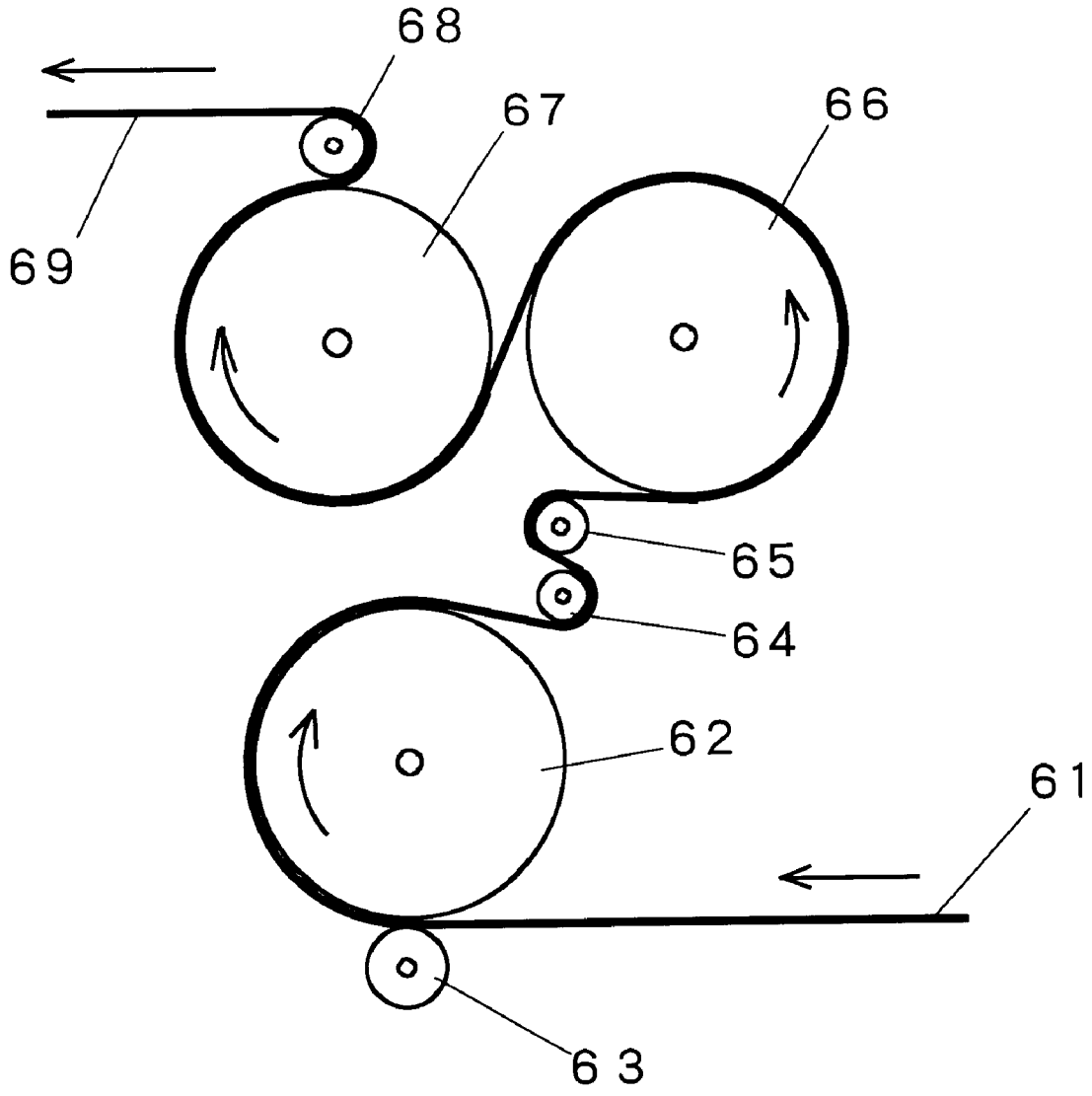
FIG. 5 is a side view of an embodiment of a short distance stretching apparatus.

FIG. 5 is a side view showing a short distance stretching method usually applied to the ordinary films or the like. A primary web 61 is preheated by a cylinder 62. The surface speed of a small diameter roll 63 is the same as that of the cylinder 62. The web is then stretched between a small diameter roll 64 and another small diameter roll 65. The web is further subjected to a heat treatment by a cylinder 66, then cooled by a cooling cylinder 67 and wound up as a stretched film 69 by way of a nip roll 68.

In the short distance stretching, because the stretching is carried out within a quite small distance between the small diameter rolls 64 and 65, the shrinkage in the width direction is small and it is possible to fix the stretching points. It is, therefore, desirable for the stretching of a film. However, in the stretching process for nonwoven fabrics according to the present invention, the method is not desirable on some occasion because filaments are liable to cling around small diameter rolls and the stability of stretching operation is sometimes lost. It should be noted, however, that the object of the present invention can be attained mostly with such nip rolls because the longitudinal alignment of filaments of web is quite good.

EXAMPLES

The embodiments of the present invention will be described in more detail with reference to several embodiments.

<Example 1 >

The value of MFR of polypropylene was converted to 250 g/10 min. by the degradation. It was spun with an MB die 1 of 0.5 mm in nozzle diameter under the conditions of a die temperature of 300° C. and a hot air temperature of 350° C. using the apparatus as shown in FIG. 1. High pressure hot air was blown out from an air reservoir 5*a* at a flow rate of 3 liter/min./nozzle and air reservoir 5*b* at a flow rate of 4 liter/min./nozzle under an ejecting angle $\alpha$ of filaments at 12°. Then air containing aqueous spray was ejected from spray nozzles 8*a* and 8*b* to the position of 250 mm under the nozzles, so that the angle $\beta$ was made 45°. Using a screen conveyer 7 of 2 mm in mesh size, 10 m/min. in traveling speed and an angle $\gamma$ of 32° relative to the horizontal surface, the filaments were subjected to suction with a reduced pressure suction nozzle 10 having the same width as that of the web, where the gap at the landing point of filaments was 8 mm.

The web 9 on the conveyer 7 was then subjected to preheating with a 500 mm diameter cylinder at 98° C. and brought into close contact with a stretching cylinder 11 by nipping with a rubber nip roll 13 and the web was longitudinally stretched at a stretching ratio of 5 while supplying 150° C. hot air having a linear cross-sectional shape from a hot air generator 31 as shown in FIG. 3 (A).

The stretching operation was further carried out using the stretching apparatus as shown in FIG. 4, in which the roll 51 was used as a heat treatment roll and the roll 54 was used as a cooling cylinder. That is, the web was stretched at a stretching ratio of 1.3 between the point P and point Q with setting the temperate of the preheating roll 43 and stretching roll 45 at 110° C., further it was stretched at a stretching ratio of 1.2 between a stretching roll 48 of 120° C. and a heat treatment roll 51 of 145° C. and the web was subjected to 5% shrinkage between a heat treatment roll 51 and a cooling cylinder 54 to obtain a longitudinally stretched nonwoven fabric. The properties of the above obtained nonwoven fabric are shown in the following Table 1.

<Comparative Example 1-1 >

The Comparative Example 1-1 is conducted in the like manner as in Example 1 except that the amount of the air stream from the air reservoir 5*a* was made the same as that from the air reservoir 5*b* of 4 liter/min./nozzle, the spinning was done in the direction just under the spinning nozzle without using the spray nozzles 8*a* and 8*b*, and the conveyer 7 was set horizontally. In addition, a reduced pressure chamber of 300 mm in length was disposed along the transferring direction of the conveyer in place of the reduced pressure suction nozzle 10 and only the heat pressing operation in Example 1 was done using the stretching cylinder 11 and the rubber nip roll 13. The results are shown in Table 1.

<Comparative Example 1-2>

When the stretching of the test sample made in Comparative Example 1-1 with a stretching ratio of 5 was tried between the stretching cylinder 11 and the take-up nip roll

14*a* in the like manner as in Example 1, severe stretch breakage took place and fuzz of the filaments clung around the stretching cylinder 11 and the take-up nip roll 14*a*. So that, the stretching operation was then carried out with a stretching ratio of 3.5 and the subsequent stretching operation was carried out in the like manner as in Example 1. The results are shown in Table 1.

<Example 2 >

A melted polyethylene terephthalate resin having an intrinsic viscosity [η] of 0.68 dl/g was extruded through an SB die 21 in FIG. 2 as a large number of filaments, in which the nozzle diameter was 0.3 mm and the die temperature was set at 330° C. The filaments were then taken up by the air 24 of the ejector 23 and the diameters of them were reduced by drafting to obtain a filament bundle 25. In this step, the cooling of filaments 22 did not caused to occur because the filaments were kept at an elevated temperature by the hot air 28 that was heated by the heater 27 located around the outside of the heat retaining wall 26 under the nozzles. After that, the cooling was done by spraying water containing 0.1%, respectively, of stretching oil agents (trademark: DELION 624 R and DELION 389 made by Takemoto Oil & Fats Co., Ltd.) together with air from the spray nozzles 8.

The direction of the flow of filaments was changed by the barrier wall plate 29 having an angle δ relative to the loading surface of conveyer 7. The filaments were then sucked by the reduced pressure suction nozzle 10 and deposited on the conveyer having an angle γ relative to the horizontal plane to be accumulated as a web.

The web on the conveyer was subjected to preheating by the 500 mm diameter cylinder heated at 85° C. After that, the web was brought into close contact with the stretching cylinder 11 by nipping with the rubber nip roll 13 and the stretching point was heated linearly by the infrared line heater 32 as shown in FIG. 3 (B) to stretch the web in the longitudinal direction at a stretching ratio of 3. In next step, stretching operation using the stretching apparatus as shown in FIG. 4 was carried out. Mean-while, the roll 51 was used as a heat treatment roll and the roll was used as a cooling roll in the like manner as in Example 1. That is, the web was stretched at a stretching ratio of 2.1 between the point P and the point Q setting the temperature of the preheating roll 43 and the stretching roll 45 at 85° C. and the web was subjected to shrinkage of 3% between the stretching roll 48 at 120° C. and the heat treatment roll 51 at 165° C. and further it was subjected to shrinkage of 2% between the heat treatment roll 51 and the cooling cylinder 54 to obtain a longitudinally stretched nonwoven fabric. The results are shown in Table 1.

<Comparative Example 2-1>

The Comparative Example 2-1 is carried out in the like manner as in Example 2 except that the heat retaining wall 26, the spray nozzle 8 and the barrier wall plate 29 were not employed and the conveyer 7 was used with horizontal setting. In addition, a reduced pressure chamber of 300 mm in length was disposed along the transferring direction of the conveyer in place of the reduced pressure suction nozzle 10 and only the heat pressing operation in Example 2 was done using the stretching cylinder 11 and the rubber nip roll 13. The results are shown in Table 1.

<Comparative Example 2-2>

It was intended to stretch the test sample obtained in Comparative Example 2-1 at a stretching ratio of 3 between the stretching cylinder 11 and take-up nip roll 14*a* in the like manner as in Example 2, however, severe stretch breakage took place and fuzz of the filaments clung around the stretching cylinder 11 and the take-up roll 14*a*. The stretching operation was then carried out by reducing the stretching ratio to 2 and the subsequent stretching operation was carried out in the like manner as in Example 2. The results are shown in Table 1.

<Example 3 >

A melted PET (polyethylene terephthalate) resin having an intrinsic viscosity [η] of 0.63 dl/g was used for spinning through an MB die 1 in FIG. 1, in which the nozzle diameter was 0.3 mm, the die temperature was 300° C. and the hot air temperature was 350° C. High pressure hot air was blown out from the air reservoir 5*a* at a rate of 4 liter/min./nozzle and from the air reservoir 5*b* at a rate of 5 liter/min./nozzle to make the ejecting angle α of the filaments 12°. Then cooling air was sprayed to the position below the nozzle by 250 mm from the spray nozzles 8*a* and 8*b* so that the angle β was made 45°. The conveyer 7 of a 2 mm mesh screen traveling at a speed of 10 m/min. with an inclination angle γ of 25° relative to the horizontal surface was used. The suction was carried out with the reduced pressure suction nozzle 10 which have the same width as that of the web. The gap at the landing point of filaments was 8 mm.

The web 9 on the conveyer 7 was preheated by the 500 mm diameter cylinder heated at 85° C. After that the web was brought into close contact with the stretching cylinder 11 with the nip roll 13 and the stretching point was heated linearly in the transverse direction with the infrared line heater as shown in FIG. 3 (B), thereby stretching the web in the longitudinal direction at a stretching ratio of 2.5.

Then, stretching operation was further carried out using the stretching apparatus as shown in FIG. 4, in which, similarly to the above description, the roll 51 was used as a heat treatment roll and the roll 54 was used as a cooling roll. That is, the web was stretched at a stretching ratio of 2 between the points P and Q with setting the temperate of the preheating roll 43 and the stretching roll 45 at 85° C. Then the stretching at a stretching ratio of 1.2 was further carried out between the stretching roll 48 of 120° C. and the heat treatment roll 51 of 165° C. with covering the space between the two rolls to form a steam chamber inside. Finally, a longitudinally stretched nonwoven fabric was obtained by subjecting the web to 3% shrinkage between the heat treatment roll 51 and the cooling cylinder 54. The results are shown in Table 1.

<Comparative Example 3-1>

The Comparative Example 3-1 is carried out in the like manner as in Example 3 except that the amount of the air stream from the air reservoir 5*a* was made the same as that of the air stream from the air reservoir 5*b* at 5 liter/min./nozzle, the spinning was done in the vertical direction below the nozzle, the spray nozzles 8*a* and 8*b* were not used, and the conveyer 7 was moved in the horizontal direction. In addition, a reduced pressure chamber of 300 mm in length was disposed along the traveling direction of the conveyer in place of the reduced pressure suction nozzle 10 and only heat pressing operation in Example 3 was carried out using the stretching cylinder 11 and the rubber nip roll 13. The results are shown in Table 1.

<Comparative Example 3-2>

When the stretching of the test sample prepared in Comparative Example 3-1 was intended at a stretching ratio of 2.5 between the stretching cylinder 11 and the take-up nip roll 14*a* in the like manner as-in Example 3, severe stretch breakage was caused to occur and fuzz of the filaments clung around the stretching cylinder 11 and the take-up roll 14*a*. So that, the stretching operation was conducted at a stretching ratio of 2 and subsequent stretching was further carried out in the like manner as in Example 3. The results are shown in Table 1.

TABLE 1

Properties of Nonwoven Fabrics

| Example | Kind of Resin | Spinning Apparatus | Total Stretching Ratio (–) | Basis Weight ($g/m^2$) | Diameter of Filament (μm) | Strength at 5% Elongation (g/d) | Breaking Strength (g/d) | Elongation (%) |
|---|---|---|---|---|---|---|---|---|
| Example 1 | PP(1) | FIG. 1 (IMB)(4) | 7.4 | 10 | 7 | 2.4 | 3.2 | 28 |
| C.Ex.(*)1-1 | " | (MB)(5) | 1 | 75 | 19 | 0.2 | 0.3 | 42 |
| C.Ex. 1-2 | " | (MB) | 5.2 | 16 | 10 | 1.1 | 1.6 | 29 |
| Example 2 | PET(2) | FIG. 2 (ISB)(6) | 6.0 | 15 | 12 | 2.2 | 2.7 | 19 |
| C.Ex. 2-1 | " | (SB)(7) | 1 | 92 | 27 | 0.3 | 0.4 | 27 |
| C.Ex. 2-2 | " | (SB) | 4.0 | 24 | 14 | 1.1 | 1.3 | 15 |
| Example 3 | PET(3) | FIG. 1 (IMB) | 5.8 | 7 | 9 | 2.0 | 2.5 | 21 |
| C.Ex. 3-1 | " | (MB) | 1 | 46 | 20 | 0.3 | 0.3 | 32 |
| C.Ex. 3-2 | " | (MB) | 4.7 | 12 | 11 | 0.9 | 1.2 | 16 |
| C.Ex. 4 | PET | (CSBF)(8) | — | 30 | 28 | 0.5 | 0.7 | 23 |
| C.Ex. 5 | PP | (CMBF)(9) | — | 30 | 2 | 0.1 | 0.2 | 18 |

Notes:
(*)C.Ex. — Comparative Example
(1)PP — Polypropylene, MFR: 250 g/10 min
(2)PET — Polyethylene terephthalate, [η]: 0.68 dl/g
(3)PET — Polyethylene terephthalate, [η]: 0.63 dl/g
(4)IMB — Improved melt blowing method
(5)MB — Melt blowing method
(6)ISB — Improved Spunbond method
(7)SB — Spunbond method
(8)CSBF — Commercially available Spunbond nonwoven fabric
(9)CMBF — Commercially available melt-bown nonwoven fabric The values of strengths in the column "Properties of Nonwoven Fabric" in Table 1 are only the data measured in the longitudinal direction according to JIS L 1096 "Test Method for Nonwoven Fabric of Long Fiber Filaments". According to JIS, the breaking strength is specified as the breaking load per 5 cm, however, the breaking strength herein is represented as the strength per denier (g/d) that is calculated by measuring a value in denier from the weight of a nonwoven fabric because each nonwoven fabric as tested has a different basis weight. Furthermore, the total stretching ratio in Table 1 is indicated by the calculation on the ratio of roll speeds involving the heat shrinkage after the stretching.

Although the strength at 5% elongation is not specified in JIS, data are shown in order to make comparison of the dimensional stability of nonwoven fabric of the present invention.

Furthermore, for the purpose of comparison, the data concerning commercially available SB nonwoven fabric (Comparative Example 4) and MB nonwoven fabric (Comparative Example 5) are also shown in Table 1. The nonwoven fabrics in Comparative Examples 1-1, 2-1 and 3-1 are lower in strengths in comparison with the commercially available SB nonwoven fabric. This may be attributed to the fact that the heat embossing treatment is not applied to the commercially available SB nonwoven fabric.

ADVANTAGES OF THE INVENTION

The nonwoven fabric according to the present invention has good alignment of longitudinal filaments and excellent longitudinal strength and dimensional stability and such a preferable fabric can be produced according to the improved method of the present invention.

The high strength and high dimensional stability in the nonwoven fabric of the present invention is characterized in that these advantageous values are not those after the reinforcing treatment such as the emboss treatment of web. In view of the fact that the conventional spunbond nonwoven fabrics and melt-blown nonwoven fabrics can be employed in practical uses only when they are subjected to reinforcing treatments such as embossing, calendering, adhesive treatment, needle punching and stitch bonding, the strength and other properties attained in the method of the present invention are epoch-making features.

The above-described characteristic features of the present invention are attributed to the improvement of the stretching property which is achieved by rapidly cooling the spun filaments so as to avoid the developing of molecular orientation and by aligning the direction of filaments. It also depends upon the results of various points such as the addition of a stretching oil agent into the aqueous spray for cooling the filaments, and the special contrivance concerning the conveyer and the reduced pressure suction nozzles, and also in the stretching process.

The nonwoven fabric according to the present invention is composed of filaments of smaller diameter because it is produced through a stretching operation at a higher stretching ratio as compared with the conventional ones. The nonwoven fabric of the invention is the so called fine denier nonwoven fabric which is excellent in touch feeling and filtering property.

Furthermore, the nonwoven fabric according to the present invention is suitable for use as a material in which the longitudinal strength is required, such as the uses for electric wire tapes, packaging tape and ribbons and adhesive impregnated fabrics. Furthermore, the nonwoven fabric of the present invention can be used for longitudinal reinforcing of ordinary nonwoven fabrics and various kinds of paper materials with desirable feeling.

In addition, the longitudinally stretched nonwoven fabric of the present invention can also be employed as a starting web for the perpendicularly cross-laminated nonwoven fabrics and obliquely cross-laminated nonwoven fabrics in the prior inventions of the present inventors as disclosed in Japanese Patent Publication No. 3-36948, Japanese Laid-Open Patent Publication No. 2-269859 and No. 2-242960 and International Patent Publication WO 96/17121.

What is claimed is:

1. A method of producing a longitudinally stretched nonwoven fabric of a web which consists of long fiber filaments of 3 $\mu$m to 15 $\mu$m in diameter and said filaments are formed by extruding a melted polymer with a spinning means having a plurality of fine nozzles and taking up said filaments at a high drafting ratio under the friction of a high speed fluid so as to accumulate said filaments on a conveyer, said method comprising the steps of:

(a) maintaining said filaments upon being extruded from the nozzles in a melted state to be drafted;

(b) thereafter cooling said filaments with a cooling fluid or an aqueous spray or cooling air;

(c) guiding a flow of said cooled filaments onto a conveyer while inclining the filaments in a direction of transferring onto said conveyer;

(d) forming a web by aspirating said filaments under a reduced pressure in a linear transverse direction from a side opposite a filament loading surface of said conveyer; and (e) subjecting said web to a short distance stretching in a longitudinal direction of said web at a stretching ratio of at least 5.

2. The method for producing a longitudinally stretched nonwoven-fabric as claimed in claim 1, wherein the loading surface of said conveyer is inclined such that said conveyer descends towards the transferring direction.

3. The method for producing a longitudinally stretched nonwoven fabric as claimed in claim 1, wherein said cooling air contains an oily agent in order to improve the stretching property and the electrostatic characteristics of said fabric.

4. The method for producing a longitudinally stretched nonwoven fabric as claimed in claim 1, wherein said spinning means includes a die for making melt-blown nonwoven fabrics wherein said fine nozzles a plurality of said spinning nozzles aligned in a row in the transverse direction and hot air jet nozzles disposed on both sides of said row of spinning nozzles.

5. The method for producing a longitudinally stretched nonwoven fabric as claimed in claim 4, wherein high-speed fluid is comprised of hot air ejected from said hot air jet nozzles and of said cooling fluid.

6. The method for producing a longitudinally stretched nonwoven fabric as claimed in claim 1, wherein said spinning means includes a die for making spunbond nonwoven fabrics which comprises a plurality of spinning nozzles and ejectors to draw at a location under said nozzles, and a heat retaining tube being arranged closely below said nozzles so as to maintain in the heat retaining tube a temperature which is higher than the spinning temperature by 80° C. or more; and ejecting said cooling fluid in a direction below said ejectors.

7. The method for producing a longitudinally stretched nonwoven fabric as claimed in claim 6, wherein said high-speed fluid is said cooling fluid.

8. The method for producing a longitudinally stretched nonwoven fabric as claimed in claim 1, wherein, in said spinning means includes a die for making melt-blown nonwoven fabrics, the flow of the filaments spun from the die being inclined towards the transferring direction of the conveyer by reducing an amount of a hot air stream emanating from slits arranged on the side of the transferring direction of the conveyer in contrast with a hot air stream emanating from the slits arranged on an opposite side thereof.

9. The method for producing a longitudinally stretched nonwoven fabric as claimed in claim 1, wherein said flow of filaments is directed toward the transferring direction of the conveyer by colliding the flow to a barrier wall disposed with an inclination relative to the loading surface of said conveyer.

10. The method for producing a longitudinally stretched nonwoven fabric as claimed in claim 1 wherein said web is subjected to multi-stage stretching operation which comprises a short distance stretching immediately after leaving the conveyer and a subsequent longitudinal stretching in the total stretching ratio of at least 5.

11. The method for producing a longitudinally stretched nonwoven fabric as claimed in claim 10, wherein the longitudinal stretching of said web is carrier out by selectively applying at least one of the following steps so as to fix a stretching point;

(a) squeezing the web using a nip roll or rolls;

(b) heating the stretching point using an infra-red heater; and (c) blowing hot air of a linear cross-section to the stretching point.

* * * * *